US009273630B2

(12) United States Patent
Joffroy

(10) Patent No.: US 9,273,630 B2
(45) Date of Patent: Mar. 1, 2016

(54) DEVICE FOR COMPRESSING A GASEOUS FLUID

(71) Applicant: BOOSTHEAT, Ales (FR)

(72) Inventor: Jean-Marc Joffroy, Cabanes (FR)

(73) Assignee: BOOSTHEAT, Ales (FR)

( * ) Notice: Subject to any disclaimer, the term of this patent is extended or adjusted under 35 U.S.C. 154(b) by 0 days.

(21) Appl. No.: 14/420,618

(22) PCT Filed: Jul. 26, 2013

(86) PCT No.: PCT/EP2013/065786

§ 371 (c)(1),
(2) Date: Feb. 9, 2015

(87) PCT Pub. No.: WO2014/023586

PCT Pub. Date: Feb. 13, 2014

(65) Prior Publication Data

US 2015/0211440 A1 Jul. 30, 2015

(30) Foreign Application Priority Data

Aug. 9, 2012 (FR) ..... 12 57738

(51) Int. Cl.

| | |
|---|---|
| ***F04B 23/00*** | (2006.01) |
| ***F02G 1/057*** | (2006.01) |
| ***F04B 25/00*** | (2006.01) |
| ***F01B 7/16*** | (2006.01) |
| ***F25B 9/14*** | (2006.01) |
| ***F25B 1/10*** | (2006.01) |
| ***F04B 35/00*** | (2006.01) |
| ***F02G 1/055*** | (2006.01) |
| *F25B 9/00* | (2006.01) |

(52) U.S. Cl.
CPC . *F02G 1/057* (2013.01); *F01B 7/16* (2013.01); *F02G 1/055* (2013.01); *F04B 25/00* (2013.01); *F04B 35/00* (2013.01); *F25B 1/10* (2013.01); *F25B 9/14* (2013.01); *F25B 9/008* (2013.01)

(58) Field of Classification Search
CPC ..... F04B 19/00; F04B 25/00; F04B 35/00; F04B 37/00; F25B 9/00; F25B 2400/072
USPC ..... 417/16, 243, 313; 62/610
See application file for complete search history.

(56) References Cited

U.S. PATENT DOCUMENTS 2,157,229 A 5/1939 Bush
3,165,172 A * 1/1965 Baker ..... F02G 1/04 123/196 AB
3,413,815 A * 12/1968 Granryd ..... F02G 1/043 417/52

(Continued)

FOREIGN PATENT DOCUMENTS

DE 10 2004 018 782 A1 11/2005
DE 102011118042 A2 * 5/2013
WO 2012/062231 A1 5/2012

*Primary Examiner* — Charles Freay
(74) *Attorney, Agent, or Firm* — Seed IP Law Group PLLC

(57) ABSTRACT

A modular device for compressing gaseous fluid includes a first stage with a first hot chamber, a second cold chamber, a piston assembly separating the first and second chambers inside a main enclosure, a regenerative heat exchanger establishing a fluid communication between the first and second chambers by at least a first communication line, and optionally third and fourth chambers separated by a fixed divider separating the third and fourth chambers placed in communication by a second communication line. It thus includes a compressor with one, two, or four stages based on a modular architecture with common components.

10 Claims, 6 Drawing Sheets

(56) References Cited

Figure 1:
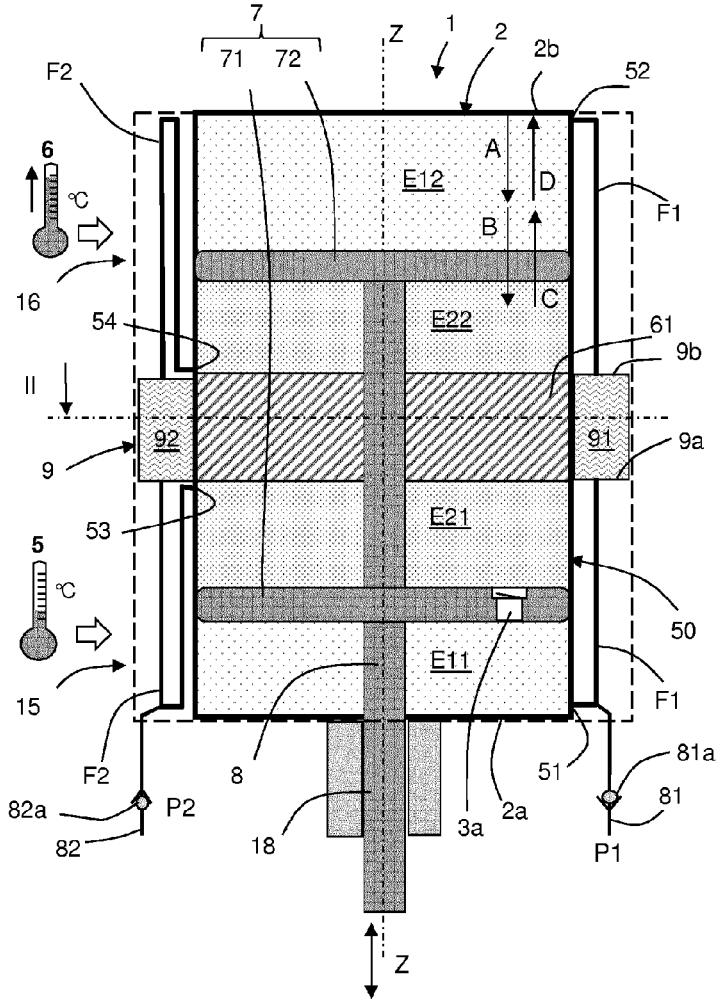

U.S. PATENT DOCUMENTS 3,921,400 A * 11/1975 Pitcher ..... F02G 1/0445 307/155
4,139,991 A * 2/1979 Barats ..... F25B 9/00 62/403
4,390,322 A * 6/1983 Budzich ..... F04B 9/115 417/243
7,013,640 B2 * 3/2006 Gregory ..... F02G 1/0535 60/517
2007/0193290 A1 * 8/2007 Ebara ..... B60H 1/00885 62/238.6
2010/0326075 A1 * 12/2010 Fong ..... F01K 25/06 60/650

* cited by examiner

DEVICE FOR COMPRESSING A GASEOUS FLUID

The present invention relates to devices for compressing a gaseous fluid, and in particular concerns heat-actuated regenerative compressors.

CONTEXT AND PRIOR ART

Multiple technical solutions already exist for compressing a gas using a heat source.

In heat-actuated regenerative compressors such as those described in documents U.S. Pat. No. 2,157,229 and U.S. Pat. No. 3,413,815, the heat received is transmitted directly to the fluid to be compressed, which eliminates the need for any mechanical element for the compression and discharge steps.

In documents U.S. Pat. No. 2,157,229 and U.S. Pat. No. 3,413,815, a displacer piston is movably mounted in an enclosure and displaces the fluid alternately towards the heating means or towards the cooling means. This displacer piston is attached to a control rod, which is connected to a control mechanism.

These devices are designed as single-stage systems, limiting the compression rate to low or moderate values. For certain compression applications requiring a significant compression rate, it is then necessary to multiply the number of single-stage compressors (by placing two, three or four of them in series), and set up a mechanical synchronization between the control mechanisms of the various stages. This increases the cost and complexity of the actual implementation, as well as the mechanical losses due to the increased number of mechanical elements. In addition, there is a risk of failure in the fluidtight seal for each stage, resulting from the presence of the synchronization mechanism.

There is a need for optimizing such multi-stage heat-actuated compressors, particularly their architecture. In particular, it would be useful to offer a compressor with one, two, or four stages, based on a modular architecture with common components.

There is also a need for increasing the service life and/or reducing the need for maintenance, particularly in the drive mechanism.

For this purpose, a device for compressing gaseous fluids is proposed, comprising:

- an inlet for gaseous fluid to be compressed and an outlet for compressed gaseous fluid,
- a cylindrical main enclosure containing gaseous fluid,
- at least one first chamber, thermally coupled to a heat source adapted for adding heat energy to the gaseous fluid,
- at least one second chamber, thermally coupled to a cold source in order to transfer heat energy from the gaseous fluid to the cold source,
- at least one piston assembly mounted in a cylindrical sleeve so as to move in an axial direction and separating the first chamber and second chamber inside said main enclosure,
- at least one regenerative heat exchanger arranged circumferentially around the sleeve and establishing a fluid communication between the first and second chambers by means of at least one first communication line, the first chamber comprising at least one first communication passage arranged at a first end of the enclosure and connected to the first communication line, the second chamber comprising at least one second communication passage arranged at a second end of the enclosure and connected to the first communication line, the first chamber, the second chamber, and the first communication line forming a first compression stage; wherein the device comprises a plurality of third and fourth passages in the form of ports arranged in an intermediate portion of the enclosure between the first and second ends, the plurality of third and fourth passages being prearranged for the fluid connection of the third and fourth chambers which are possibly arranged in the main enclosure between the first and second chambers.

By these arrangements, a compressor with two compression stages can easily be obtained from such a single-stage compressor.

In one aspect of the invention, the device can additionally comprise, within the same main enclosure, said third and fourth chambers and a first fixed divider separating the third and fourth chambers, the piston assembly comprising first and second pistons connected to each other by a rod and arranged on each side of the fixed divider, at least one second communication line establishing a communication between the third and fourth chambers through the regenerator, the third chamber, the fourth chamber and the second communication line forming a second compression stage, functionally placed serially behind the first stage; such that a two-stage compressor is obtained that is particularly suitable for good heat yield and for optimizing the synchronization between the two stages.

In various embodiments of the invention, one or more of the following arrangements may be used.

In one aspect of the invention, the regenerator can comprise at least two regenerator ring sections, independent of each other, the set of ring sections forming a ring arranged around the cylinder near the first fixed divider; this is a particularly optimized placement for organizing the regeneration function.

In another aspect of the invention, the device can comprise N stages, N being chosen from among a set of values including 2,3,4,6,8, in which the regenerator is divided into N ring sections each having an arc of 360°/N, independent of each other; such that modularity is assured from a basic single-stage compressor.

In one aspect of the invention, the device can additionally comprise third and fourth stages (N=4), the third stage comprising a hot chamber, a cold chamber, and a third communication line, the fourth stage comprising a hot chamber, a cold chamber, and a fourth communication line; such that a four-stage compressor can be obtained on a modular basis, with an architecture similar to the two-stage compressor.

In another aspect of the invention, the chambers of the fourth stage can be inserted between the chambers of the third stage, the latter being inserted between the chambers of the second stage, and those latter being inserted between the chambers of the first stage; by means of which a particularly suitable arrangement is obtained for installing four stages in a single cylinder and in particular for optimizing the heat insulation.

In another aspect of the invention, the device can additionally comprise a system for driving the piston assembly which comprises an auxiliary chamber, a rod secured to the piston assembly and axially guided, a connecting rod connected to the rod, and a flywheel connected to the connecting rod, by means of which the back and forth movement of the piston assembly can be self-sustained by said drive system.

In another aspect of the invention, the first communication line and/or the second communication line and/or the third or fourth communication line can comprise at least one external portion arranged in the respective immediate vicinity of the hot and/or cold sources, between the regenerator and at least one of the ends of the enclosure; such that the heat exchanges are maximized for each communication line.

In another aspect of the invention, the second communication line and/or the third or fourth communication line comprises a borehole into which is inserted a dissymmetrical core, whereby the external portion with maximized thermal coupling is easy to create industrially.

Lastly, the invention also relates to a thermal system comprising a heat transfer circuit and a compression device as described above. The thermal system in question can be intended to remove heat energy from an enclosed location and in such case is a cooling or refrigeration system, but the thermal system in question can just as well be intended to add heat energy to an enclosed location and in such case is a heating system such as residential heating or industrial heating for example.

Figure 2:
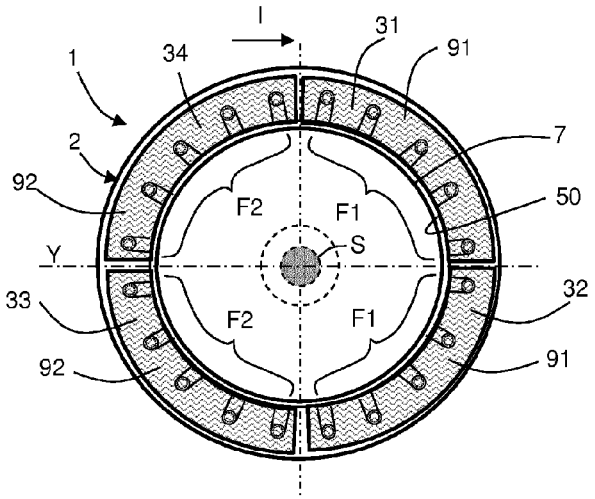
Figure 3A:
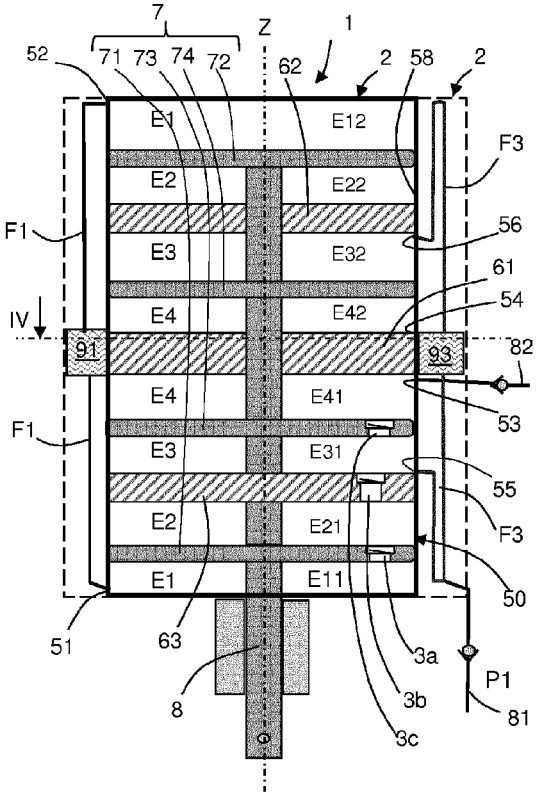
Figure 3B:
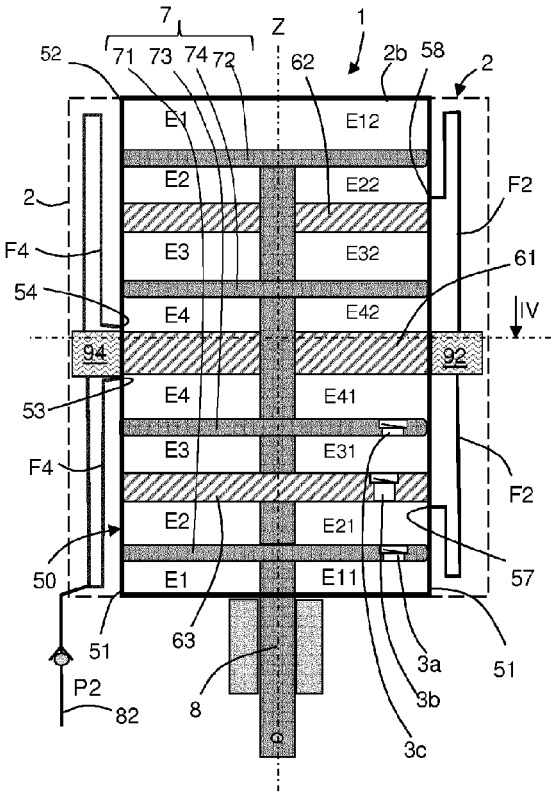
Figure 4:
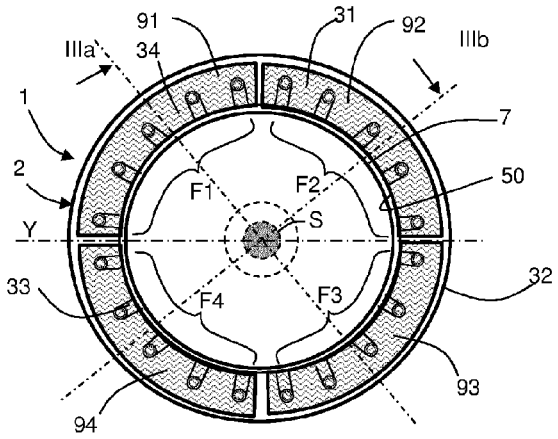
Figure 5:
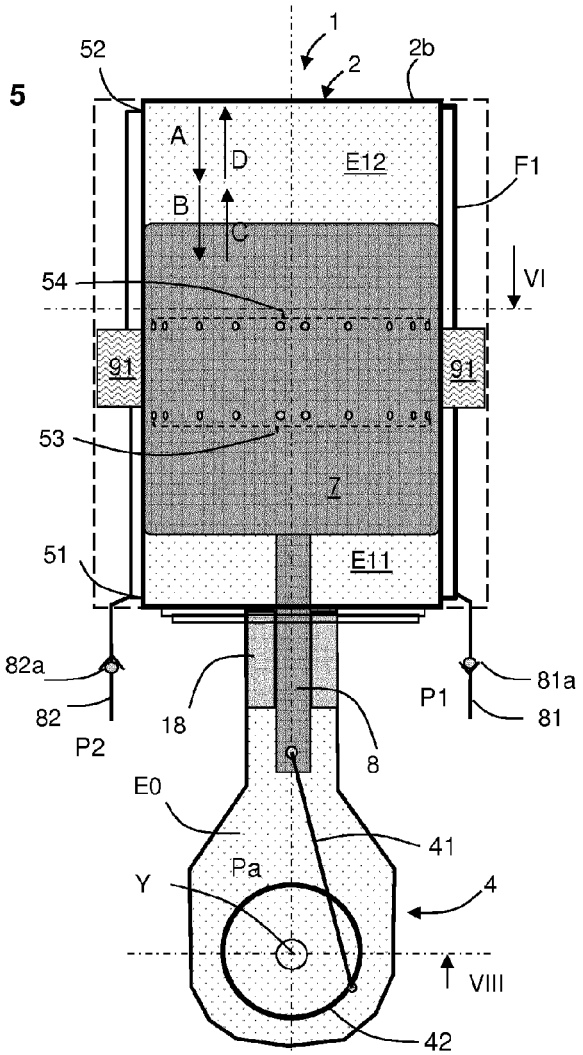
Figure 6:
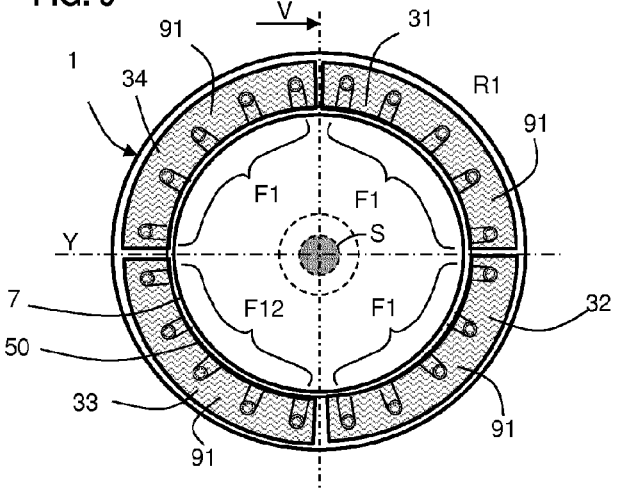
Figure 7:
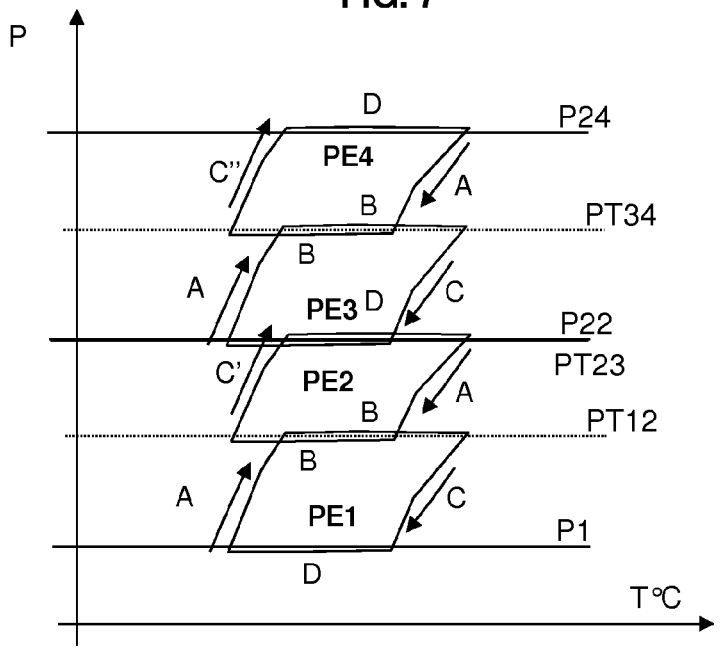
Figure 8:
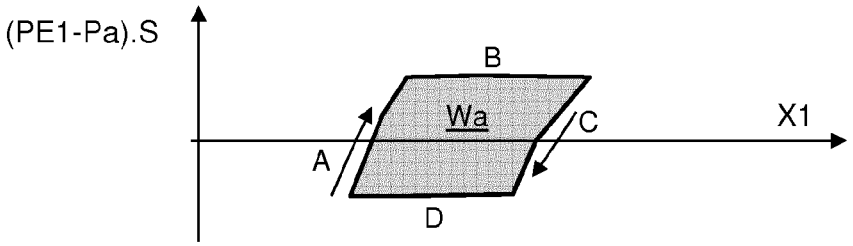
Figure 9:
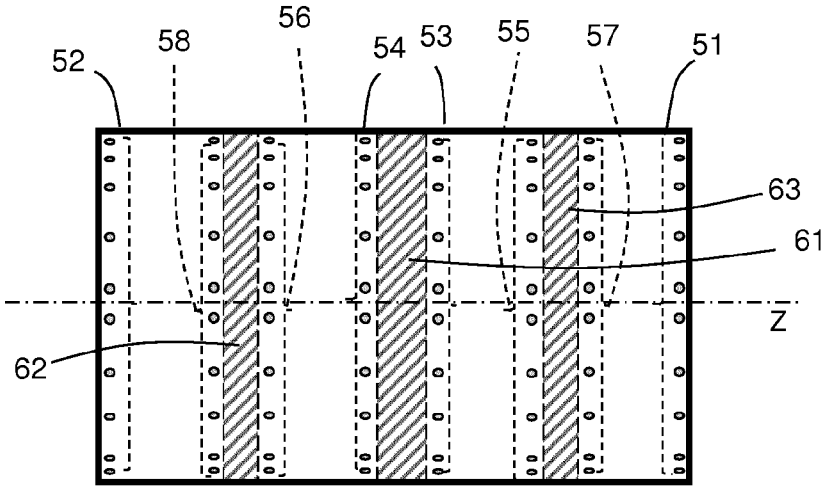
Figure 10:
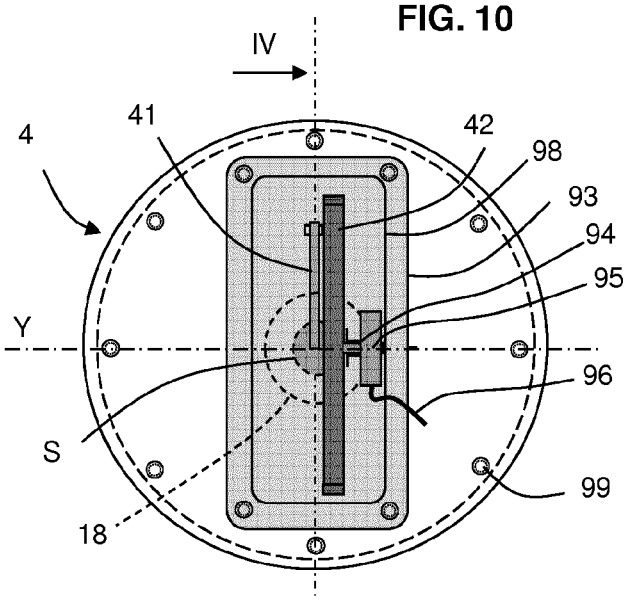
Figure 11:
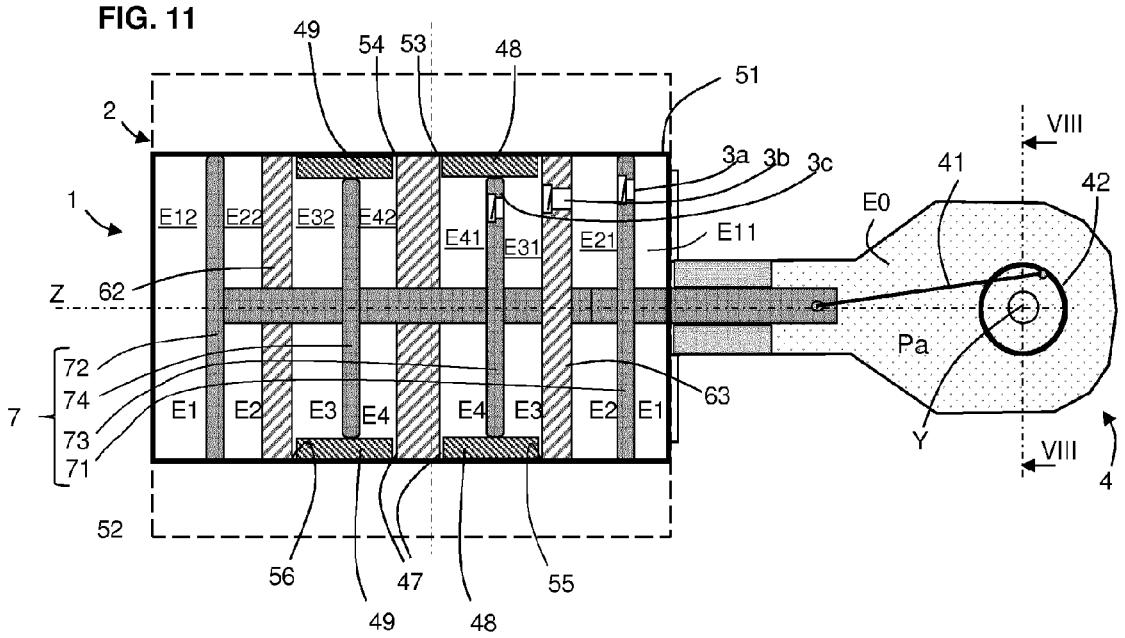
Figure 12:
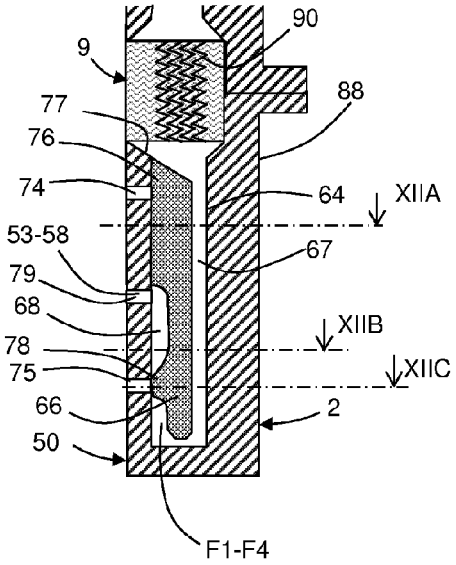
Figure 12A:
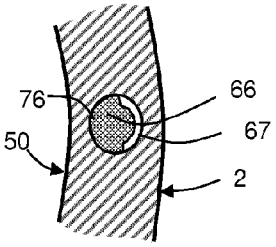
Figure 12B:
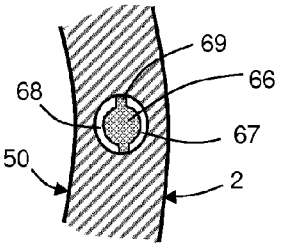
Figure 12C:
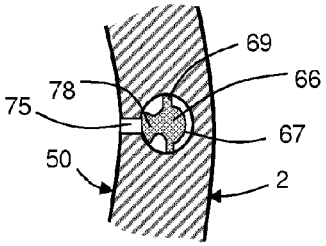

Other features, aspects, and advantages of the invention will be better understood from reading the following description of an embodiment of the invention, provided as a non-limiting example. The invention will also be better understood from the accompanying drawings, in which:

FIG. 1 is an axial cross-sectional schematic view of a gaseous fluid compression device of the invention, with two compression stages, FIG. 2 represents a transverse cross-sectional schematic view of the device in FIG. 1, FIGS. 3*a* and 3*b* are schematic axial cross-sectional views of a gaseous fluid compression device of the invention, with four compression stages, FIG. 4 represents a schematic transverse cross-sectional view of the device of FIG. 3, FIG. 5 is a schematic axial cross-sectional view of a gaseous fluid compression device of the invention, with a compression stage, FIG. 6 represents a schematic transverse cross-sectional view of the device of FIG. 5, FIG. 7 shows a diagram of the thermodynamic cycle carried out in a four-stage device, FIG. 8 represents a diagram of the cycle for the self-sustaining drive device, FIG. 9 represents a compressor cylinder which can house a compressor configuration with one, two, or four compression stages, FIG. 10 shows a self-sustaining drive device, FIG. 11 shows a variant of the device of FIG. 3, and FIGS. 12, 12A, 12B, 12C show detailed views of the communication lines of the embodiments.

In the various figures, the same reference numbers are used to denote identical or similar elements.

FIG. 1 shows a device 1 for compressing a gaseous fluid, adapted to admit a gaseous fluid (also called "working fluid") by an inlet or intake 81, at a pressure P1, and to supply the compressed fluid at pressure P2 from an outlet 82.

In the example illustrated in FIG. 1 the compression device comprises two compression stages, but in the present invention a device with a single stage or with four stages can be easily obtained based on the same architecture, as will be seen below.

The device is preferably arranged vertically along an axis Z, and has a main enclosure 2 that is generally cylindrical in shape with an axis Z. In the example illustrated, the device comprises a hot portion 16 arranged in the upper region and a cold portion 15 arranged in the lower region. The hot portion is thermally coupled to a heat source 6, which is preferably arranged adjacently around the hot portion 16 of the main enclosure, in order to provide heat energy to the hot portion of the device.

Similarly, the cold portion is thermally coupled to a cold source 5 in order to remove heat energy from the cold portion of the device. The cold source can be, for example, arranged adjacently around the cold portion 15 of the main enclosure 2 or in any other manner which establishes a good thermal coupling.

At least one piston assembly 7 is located inside the main enclosure 2, mounted in a sleeve 50 (or "cylinder") so as to move in the axial direction Z. The sleeve 50 is cylindrical with axis Z and has a smaller diameter than the diameter of the main enclosure 2.

In the two-stage example in FIG. 1, the piston assembly 7 comprises a first piston 71 and a second piston 72 connected to each other by a rod 8. Between the two pistons 71,72 is arranged a fixed divider 61 located at mid-height between an upper end 2*b* of the enclosure 2 and a lower end 2*a* of the enclosure 2. The fixed divider 61 provides thermal insulation between the hot 16 and cold 15 parts. A ring 18 surrounds the rod to supply the fluidtight and guiding functions. The rod 8 is driven in an alternately back and forth movement by a drive device which is not represented in FIGS. 1, 3*a*, 3*b*, although one of its possible embodiments will be described below.

For the cold portion 15, a first cold working chamber E11 is thus defined between the first piston 71 and the lower end of the enclosure 2*a*.

For the hot portion 16, a second hot working chamber E12 is defined between the second piston 72 and the upper end of the enclosure 2*b*.

A first communication line F1 connects, outside the sleeve, the first chamber E11 with the second chamber E12 through a regenerative heat exchanger 9 which will also more simply be called a regenerator below.

In this manner, the first chamber E11, the second chamber E12, and the first communication line F1 form an assembly called the first compression stage E1, having an internal pressure PE1 that is substantially homogeneous.

In addition, a third work chamber E21, on the cold side, is defined between the first piston 71 and the fixed divider 61, and a fourth work chamber E22 on the hot side is defined between the second piston 72 and the fixed divider 61. A second communication line F2 connects, outside the sleeve, the third chamber E21 with the fourth chamber E22 through another part of the regenerator 9.

In this manner, the third chamber E21, the fourth chamber E22, and the second communication line F2 form an assembly called the second compression stage E2, having an internal pressure PE2 that is substantially homogeneous.

Note that the chambers E21,E22 of the second stage E2 are inserted between the chambers E11,E12 of the first stage E1.

More particularly, the second piston 72 isolates the hot work chambers E12,E22, while the first piston 71 isolates the cold work chambers E11,E21, but with the addition of an check valve 3*a*, which serves as a one-way passage between the first stage E1 and the second stage E2, the second stage E2 being functionally placed serially behind the first stage E1.

When the piston assembly 7 is moved upward, the volume of chambers E21 and E12 then decreases while the volume of chambers E11 and E22 increases. The first communication line F1 causes fluid to pass into the regenerator from the top to the bottom, while the second communication line F2 causes fluid to pass from the bottom to the top into another part of the regenerator as will be seen below.

As for the regenerator 9, it is arranged around the sleeve 50 at a height midway between the upper end 2*b* and the lower end 2*a* of the enclosure. Preferably, said regenerator 9 is arranged at mid-height in the enclosure, and extends to a height which for example may be but is not necessarily close to the thickness of the fixed divider 61.

Said regenerator 9 comprises internal pipes 90 and elements for storing thermal energy, in the form of discrete or continuous elements, for example a grid of metal wires.

The regenerator 9 comprises a hot interface 9*b* to which the hot portions of the first and second lines F1, F2 are connected, and a cold interface 9*a* to which the cold portions of the first and second lines F1,F2 are connected.

Also, the regenerator 9 is partitioned into several ring sections arranged circumferentially one after another to form a ring of axis Z around the sleeve 50.

As is represented in particular in FIG. 2, for the two-stage version, one or more ring sections will be part of the first compression stage E1, while one or more complementary sections will be part of the second compression stage E2.

In the example represented here, the regenerator 9 is partitioned into four parts or sections in the form of quarter sections 31-34 each extending over an arc of about 90°. Sections 31,32 form a first regenerator portion 91 and are part of the first compression stage and are connected to the first communication line F1, while sections 33,34 form a second regenerator portion 92 and are part of the second compression stage and are connected to the second communication line F2.

The regenerator is thus distributed between a portion dedicated to the first stage and a second portion dedicated to the second stage, the fluid traversing the first portion traveling in the opposite direction of the fluid traversing the second portion.

The regenerator ring sections 31-34 are physically independent and not directly connected to each other by fluid communications. Said sections may all be identical and form a standard component.

For the first stage, the first chamber E11 comprises a first communication passage 51 arranged near the first end 2*a*; said first passage is connected to the first communication line F1, in particular the cold portion of this line. The second chamber E12 comprises a second communication passage 52 arranged near the second end 2*b*; said second passage 52 is connected to the first communication line F1, in particular the hot portion of the this line.

For the second stage, the third chamber E21 comprises a third communication passage 53 arranged near the divider 61; said third passage 53 is connected to the second communication line F2, in particular the cold portion of this line. The fourth chamber E22 comprises a fourth communication passage 54 arranged near the divider 61; said fourth passage 54 is connected to the second communication line F2, in particular the hot portion of this line.

It should be noted that the inlet 81 is connected to the first communication line F1 via valve 81*a* while the outlet 82 is connected to the second communication line F2 via valve 82*a*.

FIGS. 3*a*, 3*b* and 4 represent a compression configuration with four serially arranged stages, constructed on the same architecture as the one described above.

In this configuration, the device comprises a first compression stage E1 which comprises a cold chamber E11 arranged in the cold portion 15 of the compressor and a hot chamber E12 arranged in the hot portion 16, said chambers E11,E12 being connected to each other by a first communication line F1. Similarly to the two-stage configuration, the device comprises a second compression stage denoted E2, comprising a cold chamber E21 arranged in the cold portion and a hot chamber E22 in the hot portion, said chambers E21,E22 being connected by a second communication line F2. The second communication line F2 is connected to the corresponding cold chamber E21 by one or more passages or ports denoted 57 and is connected to the corresponding cold chamber E22 by means of one or more passages denoted 58.

In addition, the device comprises a third compression stage denoted E3 which comprises a cold chamber E31 arranged in the cold portion and a hot chamber E32 in the hot portion, said chambers E31,E32 being connected to each other outside the sleeve by a third communication line F3. The third communication line F3 is connected to the corresponding cold chamber by means of one or more passages or ports denoted 55 and is connected to the corresponding hot chamber by one or more passages denoted 56. The pressure prevailing in the third compression stage is denoted PE3.

And to finish, the device comprises a fourth compression stage denoted E4 which comprises a cold chamber E41 arranged in the cold portion and a hot chamber E42 in the hot portion, said chambers E41,E42 being connected to each other outside the sleeve by a fourth communication line F4. The fourth communication line F4 connects to the corresponding cold chamber by means of one or more passages or ports 53 already mentioned and is connected to the corresponding cold chamber by means of one or more passages denoted 54, already mentioned. The pressure prevailing in the fourth compression stage is denoted PE4.

As illustrated, the chambers of the fourth stage E4 are inserted between the chambers of the third stage E3, which themselves are inserted between the chambers of the second stage E2, which in turn are inserted between the chambers of the first stage E1. It would be possible, however, to order the stages and chambers differently without leaving the scope of the invention, for example starting from the hot end 2*b*, having the arrangement E3,E4,E1,E2 for the hot portion and E4,E3,E2,E1 for the cold portion.

The piston assembly 7 comprises a first piston 71, second piston 72, a third piston 73 and a fourth pistons 74. The first and second pistons 71,72 separate the chambers of the first and second stages E1,E2 as described for the two-stage configuration, while the third and fourth pistons 73,74 similarly separate the chambers of the third and fourth stages E3,E4. The four pistons are secured to each other by the rod 8 which slides in the ring 18.

Aside from the fixed middle divider 61 already mentioned above and again present here, there are two other fixed dividers 62,63, respectively separating the chambers of the second and third compression stages (see FIGS. 3*a*,3*b*).

To establish a communication between the different compression stages, a first check valve 3*a* is provided in the first piston as already mentioned, which allows the fluid to be transferred from the first stage to the second stage and prevents the reverse flow. Similarly, a second check valve 3*b* is provided in the third fixed divider 63 which allows the fluid to be transferred from the second stage to the third stage and prevents the reverse flow. Lastly, a third check valve 3*c* is provided in the third piston 73 which allows the fluid to be transferred from the third stage to the fourth stage and prevents the reverse flow.

For the regenerator 9, referring to FIG. 4, each ring section (here each quarter section) is specifically assigned to a stage. Thus the first ring section 31 forms the first regenerator portion 91, the second ring section 32 forms the second regenerator portion 92, the third ring section 33 forms the third regenerator portion 93, and lastly the fourth ring section 34 forms the fourth regenerator portion 94.

In this configuration, the inlet 81 is connected to the first communication line F1 while the outlet 82 is connected to the fourth communication line F4.

FIGS. 5 and 6 represent a single-stage compression configuration, constructed on the same architecture as those described above.

The piston assembly 7 is formed by a single piston of large volume which occupies a volume equivalent to the chambers of the unused upper stages.

Only one communication line F1 outside the sleeve is necessary, and it establishes a communication between the single cold chamber E11 and the single hot chamber E12.

The third and fourth passages 53,54, which form a prearrangement for the two-stage version, can be partially or completely closed off, either directly, or by communication with a blind pipe, or as will be described below.

Similarly in the single-stage configuration, the series of supplemental passages 55-58 which form a prearrangement for the four-stage version if they are present, will be closed off or blocked by any appropriate means.

In this single-stage configuration, the inlet 81 and the outlet 82 are connected to the first communication line F1, not necessarily at the same location, for example at diametrically opposite locations in order to maintain homogeneity with the two-stage configuration.

The operation of the compressor, whether it is one-, two-, or four-stage, is assured by the alternating motion of the piston 7, as well as by the action of the intake valve 81*a* at the inlet 81 and the flow check valve 82*a* at the outlet 82.

The various steps A, B, C, D, described below are represented in FIGS. 3, 5 and 7, FIG. 7 showing the evolution in the respective pressures PE1,PE2,PE3,PE4 in the respective stages and the respective temperatures relative to the stroke of the piston assembly 7, keeping in mind that the cycles concerning PE3,PE4 are only relevant for the four-stage version.

Operation of the Two-Stage Compressor

Step A.

The piston assembly 7, initially at the top, moves downwards and the volume of chambers E12,E21 increases while the volume of chambers E22,E11 decreases. Because of this, the fluid of the first stage is pushed through the first regenerator portion 91 from the bottom to the top, and heats as it passes through the first communication line F1 and through the corresponding regenerator portion. Concurrently, the fluid of the second stage is pushed through the second regenerator portion 92 from the top to the bottom, and cools as it passes through the second communication line F2 and through the corresponding regenerator portion.

Step B.

When the pressures PE1 and PE2 are at a certain value denoted PT12, the check valve 3*a* opens. Valves 81*a* and 82*a* remain closed during this period. Working fluid is consequently transferred from the first stage to the second stage. Step B ends with the end of the downstroke.

Steps C (First Stage) and C' (Second Stage).

The piston assembly 7 now moves from the bottom towards the top and the volume of chambers E22,E11 increases while the volume of chambers E12,E21 decreases. Because of this, the fluid of the first stage is pushed through the first regenerator portion 91 from the top to the bottom, and cools during its passage through the first communication line F1 and through the corresponding regenerator portion. Concurrently, the fluid of the second stage is pushed through the second regenerator portion 92 from the bottom to the top, and heats as it passes through the second communication line F2 and through the corresponding regenerator portion.

In step C which concerns the first stage, the pressure PE1 decreases until it is less than the intake pressure P1, at which point the intake valve 81*a* opens. Similarly, for step C' which is concurrent to C and concerns the second stage, the pressure PE2 increases until it is greater than the discharge pressure P22 which here is equal to the outlet pressure P2, at which point the outlet valve 82*a* opens.

Steps C and C' do not necessarily end at that point, and the two valves can open at different times.

Step D.

In this step, working fluid is expelled from chamber E21 by outlet 82 at discharge pressure P22, while the fluid at pressure P1 is admitted into the chamber E11. Step D ends with the end of the upstroke.

Four-Stage

For the operation of the four-stage compressor, referring to FIG. 7, the operation for the first two stages is identical to the above description aside from the fact that in step D the outlet from the second stage expels gas at pressure PT23 not towards the outlet but towards the third stage, through valve 3*b*.

During step A, in a manner completely similar to what has been described for the first two stages, pressure PE3 increases in the third stage while pressure PE4 decreases in the fourth stage.

During step B, working fluid at pressure PT34 is discharged through valve 3*c* from the third stage to the fourth stage.

During steps C and C", in a manner completely similar to what has been described for the first two stages, pressure PE3 decreases in the third stage (step C") while pressure PE4 increases in the fourth stage (step C), and this occurs until pressure PE4 reaches the outlet pressure P2, at which point valve 82*a* opens. Valve 3*b* opens when PE3 becomes less than PE2. Valves 81*a*, 3*b* and 82*a* can open at different times.

During step D, which begins at the respective end of steps C, C', C", fluid is expelled from the fourth stage at pressure P24 towards outlet 82, simultaneously with the transfer of fluid between the second stage and the third stage through valve 3*b* at pressure PT23 and the intake of fluid at inlet 81.

Single-Stage

For the single-stage configuration, only the cycle concerning the first stage 'PE1' is considered in FIG. 7. In this case, the outlet pressure P2 is equivalent to the discharge pressure PT12 from the first stage.

Three-Stage Version

It is equally possible to create a three-stage compressor based on the same architecture with common standard components. To do this, the use of the fourth stage can be blocked off, valve 3*c* eliminated, and the outlet from the compressor on the third communication line F3 removed. It is possible to partition the regenerator into three ring sections having a 120° arc, or to use only three of the four regenerator quarter sections mentioned above.

FIG. 5 (and also FIG. 11) shows an embodiment of the device for driving the rod and piston assembly. This embodiment can be applied in a similar to the two-stage or four-stage configurations described above.

The movements of the rod 8 can be controlled by any appropriate drive device; in the example illustrated in FIGS. 5 and 10, it concerns a self-sustaining drive device 4 acting on an end of the rod. This self-sustaining drive device 4 comprises a flywheel 42, with a connecting rod 41 connected to said flywheel by a pivoting connection. The connecting rod 41 is connected to the rod by another pivoting connection.

In the example illustrated, the self-sustaining drive device 4 is housed in an auxiliary chamber E0 filled with gaseous working fluid at a pressure denoted Pa. The sealing ring 18 is placed between the chamber E11 and the auxiliary chamber E0. When the device is operating, the pressure Pa in the auxiliary chamber E0 converges to an average pressure substantially equal to the half the sum of the min PE1min and max PE1max pressures of the first stage. When the device has been shut down for awhile, the pressure in the auxiliary chamber E0 becomes equal to the pressure prevailing in the chambers of the first stage E11,E12. The force exerted on the rod 8 can be written in the form (PE1−Pa)×S, S being the cross-sectional area of the rod.

The thermodynamic cycle, as represented in FIG. 8 which shows the resultant of the forces on the cross-sectional area of the rod as a function of its axial displacement XI, yields positive work in the self-sustaining drive device represented by the area Wa illustrated in the diagram. As a result, the back and forth movement of the piston assembly 7 can be self-sustained by said driving system 4.

The pressures are in general equilibrium in the piston assembly 7 except in the equivalent section of the rod 8. The self-sustaining work output is proportional to the cross-sectional area S of the rod and therefore the cross-sectional area S of the rod will be chosen so as to generate sufficient work.

The rotation speed of the flywheel 42 and therefore the frequency of the strokes of the piston assembly 7 is established when the force expended through friction reaches the force delivered to the rod by the thermodynamic cycle.

As illustrated in FIG. 10, a housing 98 enclosing the auxiliary chamber E0 has a base 93 which is attached to the cylinder 50 by conventional attachment means 99. In addition, the driving system 4 can comprise an electric motor 95 which is coupled to the flywheel 42 through a shaft 94 centered on Y. In the example represented in FIG. 10, the electric motor 95 is located inside the housing 98, therefore inside the enclosure where the gas is confined at pressure Pa. Only the leads 96 supplying power to the motor pass through the wall of the housing, but without any relative movement, which makes a high level of fluidtightness possible.

In a variant not represented, the electric motor is of a particular form, having a disc rotor, for example with a permanent magnet, which is placed inside the enclosure against the wall and a stator placed opposite it outside the enclosure against the wall. In this case, the electromagnetic control circuits and the leads 96 are exposed.

It is understood, however, that the motor could be entirely exposed outside the housing 98, but in this case a slip ring around the shaft is necessary.

In addition, said electric motor 95 coupled to the flywheel is adapted to impart an initial rotational movement to the flywheel in order to initialize the self-sustaining movement. In addition, the motor can be controlled in generator mode by a control unit (not represented), which allows slowing the flywheel and regulating the rotation speed of the flywheel.

During normal operation, the mechanical power delivered to the self-sustaining drive device 4 will be greater than the losses due to friction, such that residual electric power will be available (normal generator mode of operation). This extra electric power will be usable for electrically powered elements outside the compressor, including its regulation system, the pumps or fans of a cooling system, recharging a starter battery, or for cogeneration requirements.

FIG. 9 shows a possible arrangement of the different series of passages 53-58 arranged in the cylinder 50 in which the piston assembly 7 moves.

As is evident from the various descriptions provided above, the fixed dividers 61,62 63 are optional and are only installed if they are required for the configuration being constructed.

Similarly, the supplemental series of ports 55-58 could be absent if not offering the four-stage configuration.

It should be noted that although the passages and ports of the series 53-58 are represented as being present all along the circumference, it is also possible to place each of the series of ports only over the ring section necessary, for example over 180° for series 53 and 54, and for example over 90° for series 55-58.

For standardization, one could manufacture a cylinder appropriate for the configurations in 1, 2, 3 or 4 stages and could block off the unused ports via external closure as will be described below.

In a variant represented in FIG. 11, a decrease in the volume of the chambers of the third and fourth stages can be arranged in order to accommodate the increase in pressure. For this purpose, in the cold chambers and hot chambers of the third and fourth stages are respectively provided filling rings 48,49 having an inside diameter corresponding to the outside diameter of the third and fourth pistons 73,74, this diameter being substantially smaller than the diameter of the first and second pistons 71,72.

To maintain the standard arrangement of the cylindrical sleeve 50, the position of the series of ports 53,54 and where necessary the series of ports 55-58 does not require any modification, due to the transfer passages 47 arranged in the filling rings mentioned above.

FIGS. 12, 12A, 12B and 12C show a particularly advantageous embodiment concerning the communication lines F1-F4, and more particularly communication lines F2-F4 which connect to the passages or ports which are not arranged at the ends of the enclosure. To maximize the thermal coupling between the communication line and the respective heat or cold source, at least one external portion 67 arranged in the immediate vicinity of the enclosure is provided. For the cold portion 15, the external portion 67 of the communication line F2-F4 extends between the cold interface 9*a* of the regenerator and the lower end 2*a* of the enclosure. For the hot portion 16, the external portion 67 of the communication line F2-F4 extends between the hot interface 9*b* of the regenerator and the upper end 2*b* of the enclosure.

In the example illustrated here, which concerns industrially optimizing the production of such communication lines F2-F4, a blind hole 64 is bored into a piece of frame 88, its inside surface forming the cylinder 50 and its outside surface forming the external envelope of the enclosure 2. Said hole 64 is made in a direction parallel to the axis Z; one of the radial passages 53-58 opens into this hole 64. In addition, the mouth of this hole is flared 77 for connection to the regenerator 9.

Into this hole 64 is placed an insert or dissymmetrical core 66 of a shape which delimits an internal channel portion 68 and an external channel portion 67 for the communication line. In effect, the insert 66 comprises a diametric portion 69 which leaves no clearance when inserted in a circumferential direction into the hole 64 and a plugging portion 76 which forces the fluid to flow from port 53-58 first through the internal channel portion 68 then through the external channel portion 67, where the thermal exchange is maximized due to the proximity of the heat source or cold source.

In addition, the shape of the core 66 can advantageously be used to plug one or more ports 53-58 which must be sealed in the configuration used. The mouth of a port to be plugged, denoted 74, is closed off in the illustrated example by the presence of the plugging portion 76. Similarly, for a port to be plugged denoted 75 which is located between the active port 79 and the end of the enclosure, an auxiliary plugging portion 78 is provided which allows closing off the mouth of this port 75 to be plugged (see FIG. 12C). This represents a practical solution that is appropriate for selectively blocking the external mouths of the series of ports 53-58 which are not used for the configuration being constructed and which must therefore be sealed.

A person skilled in the art will understand from reading the above description that it is possible to provide a range of modular compressors constructed on a common architecture and several standard components, said range able to include a type of single-stage compressor, a type of dual-stage compressor, a type of four-stage compressor, without excluding three-stage, six-stage, or greater configurations. In particular, the cylinder is a common component, and the regenerator parts or sections are also common components. The fixed dividers 61-63 are optional components as are the filling rings 48,49. The desired configuration is obtained by managing different types of inserts 66.

As for the connecting rod assembly 41,42 of the self-sustaining drive device 4, its geometry must be adapted to the stroke of the piston assembly 7, which grows shorter as the number of stages is increased as can be seen in the figures.

It should be noted that the sectional partitioning of the regenerator could differ from the four sections of 90° each, but an advantageous partitioning consists of dividing 360° by the number of stages, meaning 360°/N if N is the number of stages.

It should be noted that the first and second passages are not necessarily ports, but may be formed as a radial opening or by any specific arrangement of the cylinder end.

It is possible for there to be not one but a plurality of valves 3*a*, 3*b*, 3*c* distributed along the circumference of the pistons or dividers concerned.

It should be noted that the piston or pistons 7 described above are equipped along their peripheral edge with a fluidtight system of varying efficiency according to the technological choices made.

It should be noted that the thickness of the middle divider 61 could be increased to improve the thermal insulation between the hot 16 and cold 15 parts of the compression device 1. Thus the thickness of the divider 61 could be near or slightly greater than the stroke of the rod 8.

It should be noted that, to avoid reheating the fluid from one stage to another, an internal cooling device inside the third divider 63 could be provided.

Similarly, to improve the dynamic behavior of the check valves between the different stages, there could be arranged in the first and third pistons 71,73 and in the third fixed divider 63 an internal compensating volume (not represented), which prevents a possible difference between pressures in the cold chambers.

The working fluid used can be chosen from among appropriate fluids, in particular it can include hydrofluorocarbons such as R410A, R407C, R744 or equivalent; CO2 can also be chosen for environmental reasons.

The speed of the alternating movement of the compressor can be chosen to be within 5 Hz to 10 Hz (300 to 600 rpm).

The pressures involved in the various compression stages can range from about ten bars to several hundred bars, depending on the working fluid chosen.

The invention claimed is:

1. A device for compressing gaseous fluid, comprising:

an inlet for gaseous fluid to be compressed and an outlet for compressed gaseous fluid;

a cylindrical main enclosure for containing the gaseous fluid;

a first chamber thermally coupled to a heat source adapted for adding heat energy to the gaseous fluid;

a second chamber thermally coupled to a cold source in order to transfer heat energy from the gaseous fluid to the cold source;

a piston assembly mounted in a cylindrical sleeve so as to move in an axial direction and separating the first chamber and second chamber inside said main enclosure;

at least one regenerative heat exchanger arranged circumferentially around the sleeve and establishing a fluid communication between the first and second chambers by at least one first communication line;

the first chamber comprising a one first communication passage arranged at a first end of the enclosure and connected to the at least one first communication line, the second chamber comprising a second communication passage arranged at a second end of the enclosure and connected to the at least one first communication line; and the first chamber, the second chamber, and the at least one first communication line forming a first compression stage;

wherein the device comprises a plurality of third and fourth passages that are ports arranged in an intermediate portion of the enclosure between the first and second ends.

2. The device for compressing gaseous fluid according to claim 1, additionally comprising, within the same main enclosure, third and fourth chambers arranged in the main enclosure between the first and second chambers, and a fixed divider separating the third and fourth chambers, the piston assembly comprising a rod and first and second pistons connected to each other by the rod and arranged on each side of the fixed divider, at least one second communication line establishing a communication between the third and fourth chambers through the at least one regenerative heat exchanger, the third chamber, the fourth chamber, and the at least one second communication line forming a second compression stage, functionally placed serially behind the first compression stage.

3. The device for compressing gaseous fluid according to claim 2, wherein the at least one regenerative heat exchanger comprises at least two regenerator ring sections, independent of each other, the at least two regenerator ring sections forming a ring arranged about the sleeve near the first fixed divider.

4. The device for compressing gaseous fluid according to claim 3, comprising N stages, N being chosen from among a set of values including 2, 3, 4, 6, 8, wherein the at least two regenerator ring sections are N regenerator ring sections each having an arc of 360°/N, independent of each other.

5. The device for compressing gaseous fluid according to claim 4, additionally comprising, within the same main enclosure, third and fourth stages, the third stage comprising a hot chamber, a cold chamber, and a third communication line, and the fourth stage comprising a hot chamber, a cold chamber, and a fourth communication line.

6. The device for compressing gaseous fluid according to claim 5, wherein the chambers of the fourth stage are positioned between the chambers of the third stage, which themselves are positioned between the chambers of the second stage, which in turn are positioned between the chambers of the first stage.

7. The device for compressing gaseous fluid according to claim 1, additionally comprising a drive system for the piston assembly, the drive system including an auxiliary chamber, a first rod secured to the piston assembly and axially guided, a second rod connected to the first rod, and a flywheel connected to the second rod, said drive system being configured to self-sustain back and forth movement of the piston assembly.

8. The device for compressing gaseous fluid according to claim 5 wherein at least one of the first, second, third, and fourth communication lines comprises at least one external portion arranged in an immediate vicinity of at least one of the hot and cold sources, between the at least one regenerative heat exchanger and at least one of the ends of the enclosure.

9. The device for compressing gaseous fluid according to claim 8, wherein at least one of the second, third, and fourth communication lines comprises a borehole and the device includes a dissymmetrical core positioned in the borehole.

10. A thermal system comprising a heat transfer circuit and a device for compressing gaseous fluid according to claim 1.

* * * * *